US009326628B2

(12) United States Patent
Kelsey

(10) Patent No.: US 9,326,628 B2
(45) Date of Patent: May 3, 2016

(54) CONFIGURABLE COASTER FOR HOLDING A MOBILE DEVICE

(71) Applicant: Frederick William Kelsey, Seattle, WA (US)

(72) Inventor: Frederick William Kelsey, Seattle, WA (US)

( * ) Notice: Subject to any disclaimer, the term of this patent is extended or adjusted under 35 U.S.C. 154(b) by 0 days.

(21) Appl. No.: 13/745,574

(22) Filed: Jan. 18, 2013

(65) Prior Publication Data

US 2014/0203160 A1 Jul. 24, 2014

(51) Int. Cl.
*B65D 5/52* (2006.01)
*A47G 23/032* (2006.01)

(52) U.S. Cl.
CPC ..... *A47G 23/032* (2013.01); *B65D 5/5206* (2013.01)

(58) Field of Classification Search
USPC ..... 248/459, 460, 461; 206/45.24–45.27, 206/45.2, 45.21; 220/737
See application file for complete search history.

(56) References Cited

U.S. PATENT DOCUMENTS

| | | | | | |
|---|---|---|---|---|---|
| 844,066 | A * | 2/1907 | Warren | 248/459 |
| 1,146,103 | A * | 7/1915 | Roy | 248/459 |
| 1,675,060 | A * | 6/1928 | Simmons | 248/459 |
| 1,897,305 | A * | 2/1933 | Doherty | 248/459 |
| 2,726,835 | A * | 12/1955 | Hummel | 248/459 |
| 3,097,444 | A * | 7/1963 | Steiner | 248/454 |
| 3,410,516 | A * | 11/1968 | Criswell | 248/459 |
| 3,937,435 | A * | 2/1976 | Roberts | 248/464 |
| 4,674,724 | A * | 6/1987 | Gaudet | 248/459 |
| 5,029,798 | A * | 7/1991 | Clark | 248/459 |
| 5,234,190 | A * | 8/1993 | Cross | 248/459 |
| 6,568,543 | B1 * | 5/2003 | Schneider | 211/43 |
| 7,185,869 | B2 * | 3/2007 | Smith | 248/456 |
| 7,527,235 | B2 * | 5/2009 | Hummel | 248/459 |
| 7,861,995 | B2 * | 1/2011 | Liou | 248/454 |
| 8,100,376 | B2 * | 1/2012 | Ye | 248/454 |
| 8,314,373 | B1 * | 11/2012 | Watkins | H05B 6/6408 219/730 |
| 8,424,829 | B2 * | 4/2013 | Lu et al. | 248/371 |
| 2007/0194201 | A1 * | 8/2007 | Dempsey | 248/459 |
| 2008/0230672 | A1 * | 9/2008 | Pachowski | 248/453 |
| 2012/0318950 | A1 * | 12/2012 | Wilber | 248/459 |

* cited by examiner

*Primary Examiner* — Alfred J Wujciak
(74) *Attorney, Agent, or Firm* — Arjomand Law Group, PLLC

(57) ABSTRACT

A method and an article of manufacture are disclosed for making and using a configurable coaster to support a drink cup on a table and also to use as a stand for a smartphone. In various embodiments, a sheet material, such as cardboard, plastic, laminates, and the like is used to create a flat plate having partially perforated or grooved lines in a pattern that defines various flaps configured to allow transformation of the flat plate into a smartphone stand by bending the flaps to create a three-dimensional stand. Before transformation, the flat plate may be used as a coaster for placing under cups and glasses. After transformation, the flat plate may be used as a stand for cellphones, books, small electronic devices, pictures, or any other object or device that may stand for display, presentation, or operation.

9 Claims, 3 Drawing Sheets

CONFIGURABLE COASTER FOR HOLDING A MOBILE DEVICE

TECHNICAL FIELD

This application relates generally to coasters. More specifically, this application relates to a coaster configurable for use with a drink glass and for supporting a smartphone on table top.

BRIEF DESCRIPTION OF THE DRAWINGS

The drawings, when considered in connection with the following description, are presented for the purpose of facilitating an understanding of the subject matter sought to be protected.

DETAILED DESCRIPTION

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references paper material in the construction of the configurable coaster, it will be appreciated that the disclosure may include other types of materials, such as plastic, metal, leather, multi material laminates, and the like.

Briefly described, a method and an article of manufacture are disclosed for making and using a configurable coaster to support a drink cup on a table and also to use as a stand for a smartphone. In various embodiments, a sheet material, such as cardboard, plastic, laminates, and the like is used to create a flat plate having partially perforated or grooved lines in a pattern that defines various flaps configured to allow transformation of the flat plate into a smartphone stand by bending the flaps to create a three-dimensional stand. Before transformation, the flat plate may be used as a coaster for placing under cups and glasses. After transformation, the flat plate may be used as a stand for cellphones, books, small electronic devices, pictures, or any other object or device that may stand for display, presentation, or operation.

With the ubiquity of cell phones, and more recently, smartphones, more and more people carry these devices almost everywhere they go, including restaurants, cafeterias, meetings, coffee houses, home, offices, gyms, classrooms, and the like. In many of these public or private settings, people drink hot or cold beverages and also check their messages or do other administrative, communications, or computing tasks using their smartphones. Those skilled in the art will appreciate that smartphones are computing devices which have voice and data communication capabilities, computing capabilities, sometimes have small cameras and video recording devices embedded, and have many software applications ("app") for performing various tasks and utilities such as calendar, notes, maps, games, contact lists, web browsers, and the like.

When sitting at a table with a drink, a user may want to lay down his smartphone in a convenient position to comfortably see the screen and use the keypad or touch-sensitive screen. Laying the phone flat on the table may present a viewing and working angle which is not very comfortable to the user. Thus, a method of holding a smartphone at an angle on a table which allows the user to conveniently access the phone, particularly with one hand, is highly desirable. Such method is even more useful, if the user does not have to carry a kick stand for his smartphone, which adds to the weight and bulk of the mobile phone, usually an undesirable effect.

Figure 1:
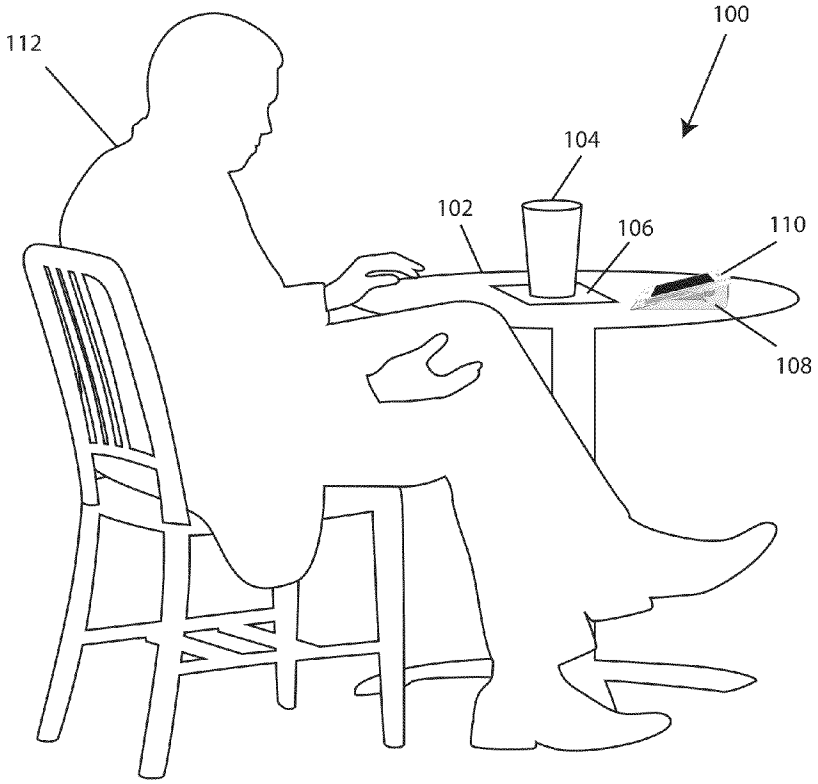
FIGS. 1 shows an example environment where a configurable coaster may be used.

FIGS. 1 shows an example environment where a configurable coaster may be used. In various embodiments, sitting arrangement 100 includes table 102, cup or glass 104, coaster 106, stand 108, mobile device 110, allowing user 112 to effectively used mobile device 110 with one hand or hands free.

In various embodiments, coaster 106 may be configurable, using flaps built into the coaster, which may be bent to form a 3-dimensional (3-D) stand 108 to hold mobile device 110 at a convenient viewing angle. Such configurable coasters may be supplied by the establishment in which the user is sitting, such as coffee houses, restaurants, cafeterias, offices, stores, and the like.

Figure 2A:
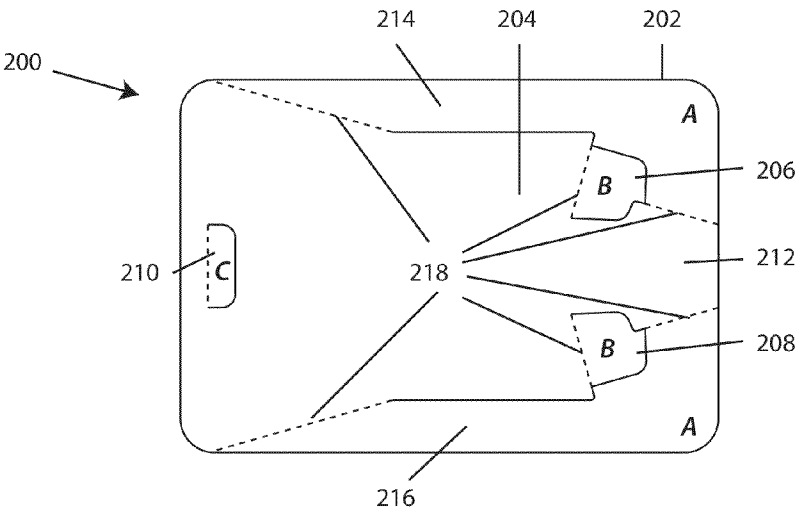
FIG. 2A shows an example embodiment of a configurable coaster and the appropriate cutouts for transformation of the coaster to a smartphone holder.

FIG. 2A shows an example embodiment of a configurable coaster and the appropriate cutouts for transformation of the coaster to a smartphone holder. In various embodiments, configurable coaster 200 includes body or base plate 202, support surface 204, lock flaps 206 and 208, stop tab 210, head area 212, side flaps 214 and 216, and partial perforations or grooves 218, shown as dotted lines.

In various embodiments, base plate 202 is flat and constructed from cost effective and semi rigid material, such as thick paper, cardboard, plastic, laminates, metallic foil, a combination of the above, and the like. In some embodiments, the base plate may be rubberized or otherwise coated to create a relatively high coefficient of friction between the base plate and the body of a mobile device, such as a smartphone or cellphone, to prevent slippage.

With continued reference to FIG. 2A, flap patterns may be provided on the flat base plate as solid and dotted lines, which define the boundaries of the flaps to be used to create a 3-D stand. The flap patterns are generally coplanar with the base plate. The solid lines represent complete cut-through grooves on the base plate to allow separation of the corresponding portions of the edges of the flaps from the base plate. The dotted lines represent partial grooves or weakened parts of the base plate, which constitute folding lines along which the flaps are folded. Thus, the flap patterns are engraved or carved into the base plate.

In various embodiments, in operation, the user may bend the various flaps, identified by the partial or complete cut lines, to form a 3-D stand. The flaps may have different roles in the structure of the stand. Some flaps may be the main support, such as side flaps 214 and 216, some flaps may be used to lock the main support flaps, such as lock flaps 206 and 208, and some flaps may be used to stop slippage of the device, such as stop tab 210. So, the user may use one configurable coaster, without bending the flaps, as a regular coaster for placing cups on a table, and use another configurable coaster to create a stand for his mobile device or other object he may want to place on the stand, such as a small book, a note, a card, and the like.

Those skilled in the art will appreciate that many other types, sizes, shapes, and configurations of foldable flaps may be devised without departing from the spirit of the present disclosures. For example, instead of two support flaps, three support flaps may be used. And instead of having separate locking flaps, the support flaps may have a built-in notch, fingers, or other structure for keeping the support flaps in locked position.

In various embodiments, when bending the various flaps, some portions of the flap, represented by dotted lines in FIG. 2A, are partially cut into the depth or thickness of the base plate 202, to allow easy and clean bending of the flap without causing dimensional non-uniformity, crookedness, or wrinkles in the flap or base plate. The partial cut allows the flap to stay connected to the base plate but to also bend easily and neatly to form the 3-D stand. The full through-cuts, designated by solid lines in FIG. 2A, create a complete separation of portions of the flap from the base plate to allow desirable 3-D shapes to be constructed from a flat 2-D base plate, as further illustrated with respect to FIG. 2B below.

Figure 2B:
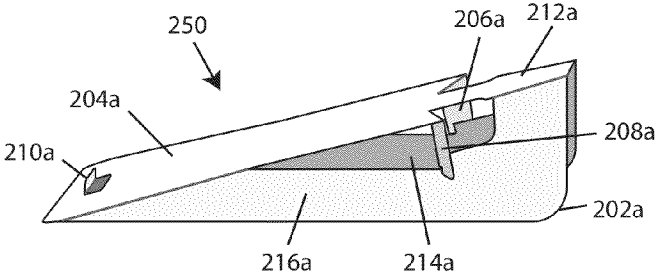
FIG. 2B shows the example embodiment of the configurable coaster of FIG. 2A, after transformation to a smartphone holder.

FIG. 2B shows the example embodiment of the configurable coaster of FIG. 2A, after transformation to a smartphone holder. In various embodiments, 3-D stand 250 includes body or base plate 202*a*, support surface 204*a*, lock flaps 206*a* and 208*a*, stop tab 210*a*, head area 212*a*, side flaps 214*a* and 216*a*, all shown after transformation of the configurable coaster.

In various embodiments, in operation, the support flaps 214*a* and 216*a* are bent down with respect to support surface 204*a* approximately 90° to form vertical support members and create a slopping support surface 204*a* with respect to a horizontal surface of a table on which the stand may be placed. The support surface 204*a* slopes downwards from head area 212*a* down to stop tab 210*a*. Next, lock flaps 206*a* and 208*a* are bent down in the same direction as the support flaps to lock the support flaps in place and prevent them from swinging back upwards to become coplanar with the support surface 204*a* again. Next, the stop tab 210*a* is bent upwards with respect to support surface 204*a* approximately 90° to form a stop member to prevent any object, such as a smartphone, placed on the support surface 204*a* from sliding downwards and off the support surface.

Figure 3A:
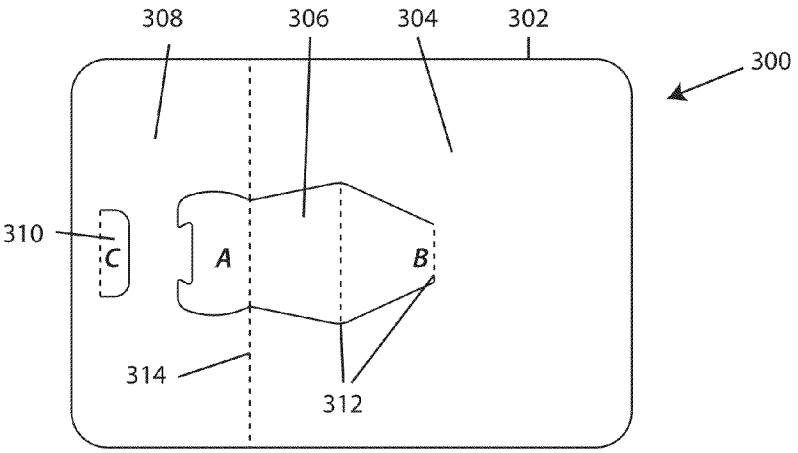
FIG. 3A shows another example embodiment of a configurable coaster and the appropriate cutouts for transformation of the coaster to a smartphone holder.

FIG. 3A shows another example embodiment of a configurable coaster and the appropriate cutouts for transformation of the coaster to a smartphone holder. In various embodiments, configurable coaster 300 includes body or base plate 302, upper support surface 304, support flap 306, lower support surface 308, stop tab 310, and partial perforations or grooves 312 and 314, shown as dotted lines.

In various embodiments, base plate 302 is constructed from cost effective and semi rigid material, such as think paper, cardboard, plastic, laminates, metallic foil, a combination of the above, and the like. In some embodiments, the base plate may be rubberized or otherwise coated to create a relatively high coefficient of friction between the base plate and the body of a mobile device, such as a smartphone or cellphone, to prevent slippage. With reference to FIG. 3A, the solid lines represent complete cut-through of the base plate to allow separation of the corresponding portions of the edges of the flaps from the base plate.

In various embodiments, in operation, the user may bend the various flaps, identified by the partial or complete cut lines, to form a 3-D stand. One or more flaps may be used as the main support, such as center flap 306. So, the user may use one configurable coaster, without bending the flaps, as a regular coaster for placing cups on a table, and use another configurable coaster to create a stand for his mobile device or other object he may want to place on the stand, such as a small book, a note, a card, and the like.

In various embodiments, when bending the center flap, some portions of the flap, represented by dotted lines in FIG. 3A, are partially cut into the depth or thickness of the base plate 302, to allow easy and clean bending of the flap without causing dimensional non-uniformity, crookedness, or wrinkles in the flap or base plate. The partial cut allows the flap to stay connected to the base plate but to also bend easily and neatly to form the 3-D stand. The full through-cuts, designated by solid lines in FIG. 3A, create a complete separation of portions of the flap from the base plate to allow desirable 3-D shapes to be constructed from a flat 2-D base plate, as further illustrated with respect to FIG. 3B below.

Figure 3B:
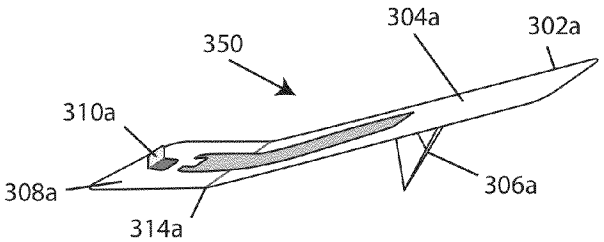
FIG. 3B shows the example embodiment of the configurable coaster of FIG. 3A, after transformation to a smartphone holder.

FIG. 3B shows the example embodiment of the configurable coaster of FIG. 3A, after transformation to a smartphone holder. In various embodiments, 3-D stand 350 includes body or base plate 302*a*, support surface 304*a*, center flap 306*a*, stop tab 310*a*, and upper support surface 304*a*, all shown after transformation of the configurable coaster.

In various embodiments, in operation, the support flap 306*a* is folded along the dotted lines 312 and bent down with respect to upper support surface 304*a*. The flap is further folded to form a triangular A-frame type or V-shaped support member and create a sloping upper support surface 304*a* with respect to a horizontal surface of a table on which the stand may be placed. With reference to FIG. 3A, notch A of flap 306 may be used anchor or lock the notch end of the center flap to end B the center flap, which is attached to the base plate 302 like a hinge, by surrounding the attached portion of end B with the notch. The upper support surface 304*a* slopes downwards to stop tab 310*a* on lower support surface 308*a*. The V-shaped support secured this way using the notch A, provides a stable stand for a small device (like a smartphone, PDA, etc.), a book, or other object. Next, the stop tab 310*a* is bent upwards with respect to the lower support surface 308*a* approximately 90° to form a stop member to prevent any object, such as a smartphone, placed on the upper support surface 304*a* from sliding downwards and off the support surface.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. An article of manufacture configured to be used as a coaster and a Smart-Phone stand, the article of manufacture comprising:

one continuous sheet of material configured to be used as a coaster having a base plate, a support surface, and a head area on one side of the support surface;

a flap pattern engraved into the sheet to be folded to create a three-Dimensional ("3-D") stand, wherein the created stand does not include any other part in addition to the sheet;

a stop tab bendably attached to the support surface via partially perforated grooves, wherein the stop tab is located on another side of the support surface opposite the head area;

two side flaps bendably attached to the support surface via partially perforated grooves to support weight placed on the support surface, and forming the outer edges of the support surface when bent downward relative to the support, wherein the head area becomes narrower, when the two side flaps are bent downward, than the another side of the support surface where the stop tab is located; and two lock flaps bendably attached to the support surface via partially perforated grooves substantially perpendicular to the partially perforated grooves of the two side flaps in a plane of the support surface, and unattached to the side flaps, configured to lock the two side flaps in bent position, wherein no part of the sheet of material is folded over another part to make a multi-layer surface.

2. The article of manufacture of claim 1, wherein the sheet is made from at least one of cardboard, plastic, and laminate material.

3. The article of manufacture of claim 1, wherein the flap pattern is coplanar with the base plate.

4. The article of manufacture of claim 1, wherein the flap pattern includes partial grooves and cut-through grooves deployed into the sheet.

5. The article of manufacture of claim 1, wherein the flap pattern is configured to create a foldable flap.

6. The article of manufacture of claim 1, wherein the flap pattern is configured to create a plurality of foldable flaps, each foldable flap having a distinct function.

7. The article of manufacture of claim 6, wherein the plurality of foldable flaps includes a support flap, a lock flap, and a stop tab.

8. The article of manufacture of claim 7, wherein the foldable flaps are configured to create a 3-D stand having a support surface sloping from one end of the sheet to a second end of the sheet.

9. The article of manufacture of claim 7, wherein the foldable flaps are configured to create a 3-D stand having a support surface sloping from one end of the coaster to a second end of the coaster.

* * * * *